US012096903B2

(12) United States Patent
Hoover

(10) Patent No.: US 12,096,903 B2
(45) Date of Patent: Sep. 24, 2024

(54) PLASTIC STORAGE BAG SAVER

(71) Applicant: Chris Hoover, Windsor, CA (US)

(72) Inventor: Chris Hoover, Windsor, CA (US)

( * ) Notice: Subject to any disclaimer, the term of this patent is extended or adjusted under 35 U.S.C. 154(b) by 139 days.

(21) Appl. No.: 17/825,931

(22) Filed: May 26, 2022

(65) Prior Publication Data

US 2023/0380656 A1 Nov. 30, 2023

(51) Int. Cl.
*A47L 15/50* (2006.01)

(52) U.S. Cl.
CPC ..... *A47L 15/505* (2013.01)

(58) Field of Classification Search
CPC . B65B 67/12; B65B 67/1205; B65B 67/1255; B65F 1/1415; B65F 2240/138; A47L 15/505
USPC ..... 248/95, 97, 99, 175; 211/45, 85.15, 211/85.31, 181.1
See application file for complete search history.

(56) References Cited

U.S. PATENT DOCUMENTS 1,006,328 A * 10/1911 Widenhofer ..... D06F 57/08 211/195
3,161,391 A * 12/1964 Bahnsen ..... D06F 95/004 248/99
3,186,667 A * 6/1965 Meuer ..... B65B 67/1238 248/97
4,364,534 A * 12/1982 Valesko ..... B65B 67/1205 248/153
4,893,769 A * 1/1990 Rotelli ..... B65B 67/1255 248/153
5,213,291 A * 5/1993 Wiebe ..... B65B 67/1227 D34/5
5,263,672 A * 11/1993 He ..... B65B 67/1205 248/97
5,427,340 A * 6/1995 Stromsmoe ..... B65B 67/1205 248/97
5,794,792 A * 8/1998 Convertino ..... A47L 19/04 211/12
5,799,908 A * 9/1998 Downs ..... B65B 67/1227 220/908
6,267,334 B1 * 7/2001 Siu ..... B65B 67/1211 248/97
6,402,098 B2 * 6/2002 Rosky ..... B65B 67/1227 53/390
6,467,735 B1 * 10/2002 Clinton ..... B65B 67/12 248/153
6,843,453 B1 * 1/2005 Rogers ..... B65B 67/1205 248/99
6,955,274 B2 * 10/2005 Delery ..... D06F 95/002 383/7

(Continued)

*Primary Examiner* — Christopher Garft
*Assistant Examiner* — Michael McDuffie
(74) *Attorney, Agent, or Firm* — My Patent Guys; Christopher Pilling

(57) ABSTRACT

A plastic storage bag saver is provided. The plastic bag saver has a pair of base rods configured to rest on a dishwasher rack. A pair of vertical arched support rods extending from the pair of base rods, wherein the pair of vertical arched support rods forms a bag spreader configured to spread and secure a flexible plastic storage bag in an open position. The pair of base rods and the pair of vertically arched rods are formed via a single bent rod. The plastic storage bag saver is an environmentally conscious product that allows for the normally discarded plastic storage bag to be reused after being washed in a dishwasher.

8 Claims, 5 Drawing Sheets

(56) References Cited

U.S. PATENT DOCUMENTS

| | | | | |
|---|---|---|---|---|
| 6,994,301 | B1 * | 2/2006 | Fox | B65B 67/1205 211/85.15 |
| 8,579,121 | B2 * | 11/2013 | Eng | A47L 19/04 211/41.9 |
| 8,925,875 | B2 * | 1/2015 | Horvath | B65F 1/1415 248/440 |
| 8,955,806 | B1 * | 2/2015 | Watson | A47L 15/505 383/11 |
| 11,091,287 | B1 * | 8/2021 | Krechowiecki | B65B 67/12 |

* cited by examiner

PLASTIC STORAGE BAG SAVER

CROSS-REFERENCE TO RELATED APPLICATIONS

N/A

BACKGROUND OF THE INVENTION

1. Field of the Invention

The present invention relates generally to environmentally conscious products and more particularly to a plastic storage bag saver.

2. Description of Related Art

Plastic storage bags, also called zipper storage bags, slider storage bags, zipper bags, or Ziploc® bags are flexible rectangular storage bags made of plastic. Such a bag is designed to be sealed and opened many times by a fastener, such as a mechanical sealing mechanism sealed by a user's fingers.

These bags are usually thrown away after single use or when the inside of the bag is subjected to liquids, or food particles, especially strong smelling foods, like tuna fish. In fact, as of 2020, each family uses an average of 500 plastic storage bags each year. Reducing this waste will be beneficial to the environment and will lower the amount of toxins and microplastics in the environment. However, manually cleaning the bag for reuse is burdensome. Consequently, a solution is provided which allows for the plastic storage bag to be washed for reuse in a conventional dishwasher.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide an environmentally conscious product that allows for the normally discarded plastic storage bag to be reused after being washed in a dishwasher.

In order to do so a plastic storage bag saver is provided, comprising a pair of base rods configured to rest on a dishwasher rack; a pair of vertical arched support rods extending from the pair of base rods, wherein the pair of vertical arched support rods form a bag spreader configured to spread and secure a flexible plastic storage bag in an open position; and, wherein the pair of base rods and the pair of vertically arched rods are formed via a single bent rod.

In one embodiment, the single bent rod is comprised of stainless steel. In one embodiment, the single bent rod is ⅛" diameter. In one embodiment, the pair of base rods horizontally extend from the pair of vertical arched support rods. In one embodiment, the pair of vertical arched support rods includes at least one angled portion approximate to a proximal portion of the pair of vertical arched support rods, wherein the at least one angled portion reduces tension stress forces of the flexible plastic storage bag's seam. In another embodiment, the at least one angled portion is at an acute angle relative to a vertical axis. In yet another embodiment, the pair of vertical arched support rods are bowed outwardly such that the bag spreader is configured to spread the flexible plastic storage bag's lower corners.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

Figure 1:
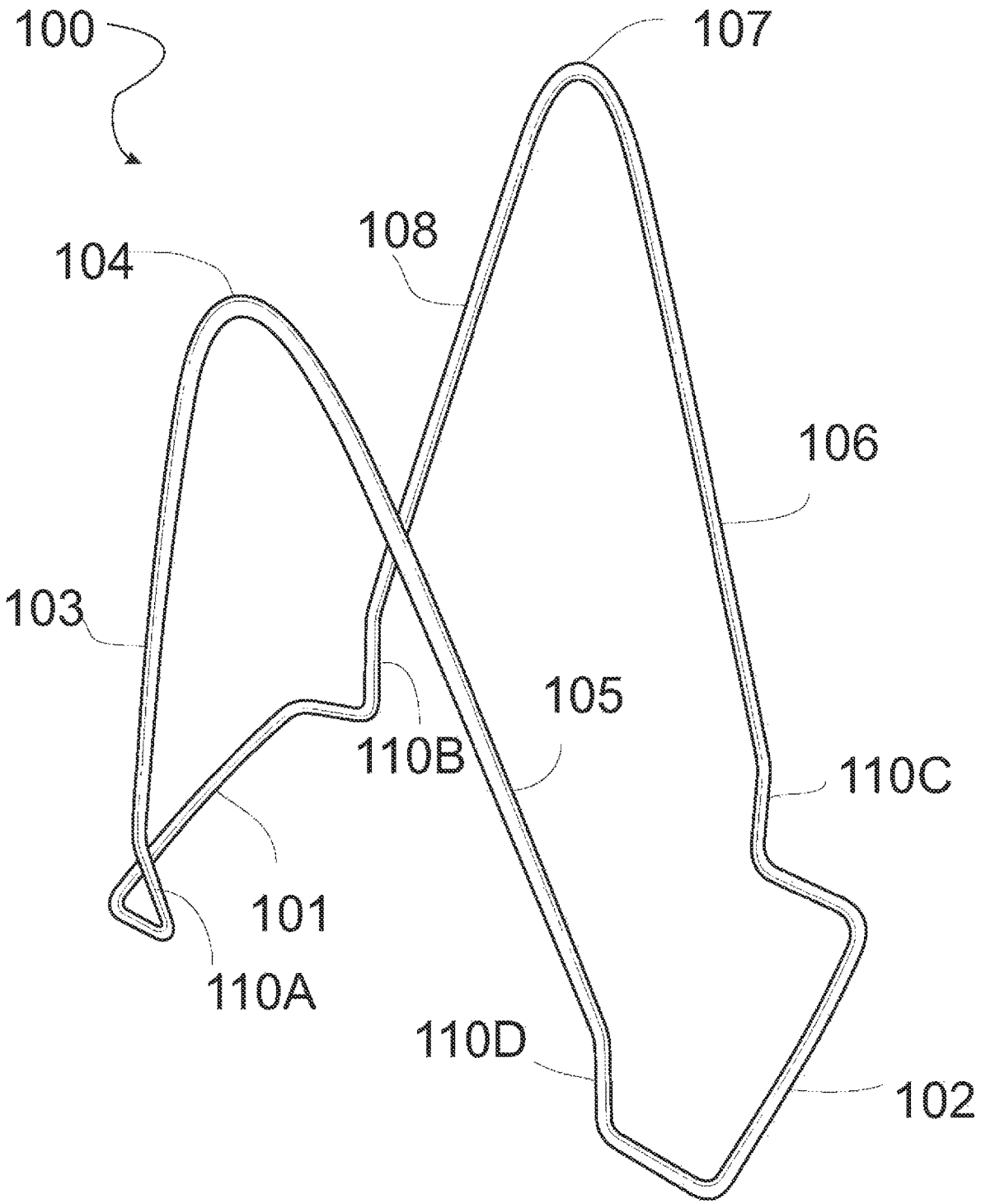
FIG. 1 is a perspective view of a plastic storage bag saver according to an embodiment of the present invention.

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein to specifically provide a plastic storage bag saver.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about", "generally", or "approximately" apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Referring now to any of the accompanying FIGS. 1-4, a plastic storage bag saver 100 is illustrated. In one embodiment, the plastic storage bag saver is a continuous shaped rod, bent and formed as illustrated. The construction and forming of the rod may vary, for example it may be two identical sections welded or bonded together or multiple sections combined to form the continuous rod loop. For the purposes of the disclosure and claims, this may be referred to as a single rod, even if it is multiple rods combined together.

In one embodiment, the plastic storage bag saver 100 comprises a pair of base rod sections 101 and 102, wherein the base rod sections are configured to stand on a surface. As the intended use of the present invention is for washing plastic storage bags in a dishwasher, each pair of base rods is configured to rest on a dishwasher rack. The plastic bag saver is further comprised of a pair of vertical arched support rods extending from the pair of base rods, wherein the pair of vertical arched support rods form a bag spreader configured to spread and secure a plastic storage bag in an open position (best seen in FIG. 2). More specifically, a first left arch member 103 or voussoir member extends from base 101 leading to a first crown 104, wherein the first crown 104 leads into a first right arch member 105 which extends to base 102 forming a first arch. Similarly, a second right arch member 106 extends from base 102 leading to a second crown 107, wherein the second crown 107 leads into a second left arch member 108 which extends to base 101 forming a second arch.

Figure 2:
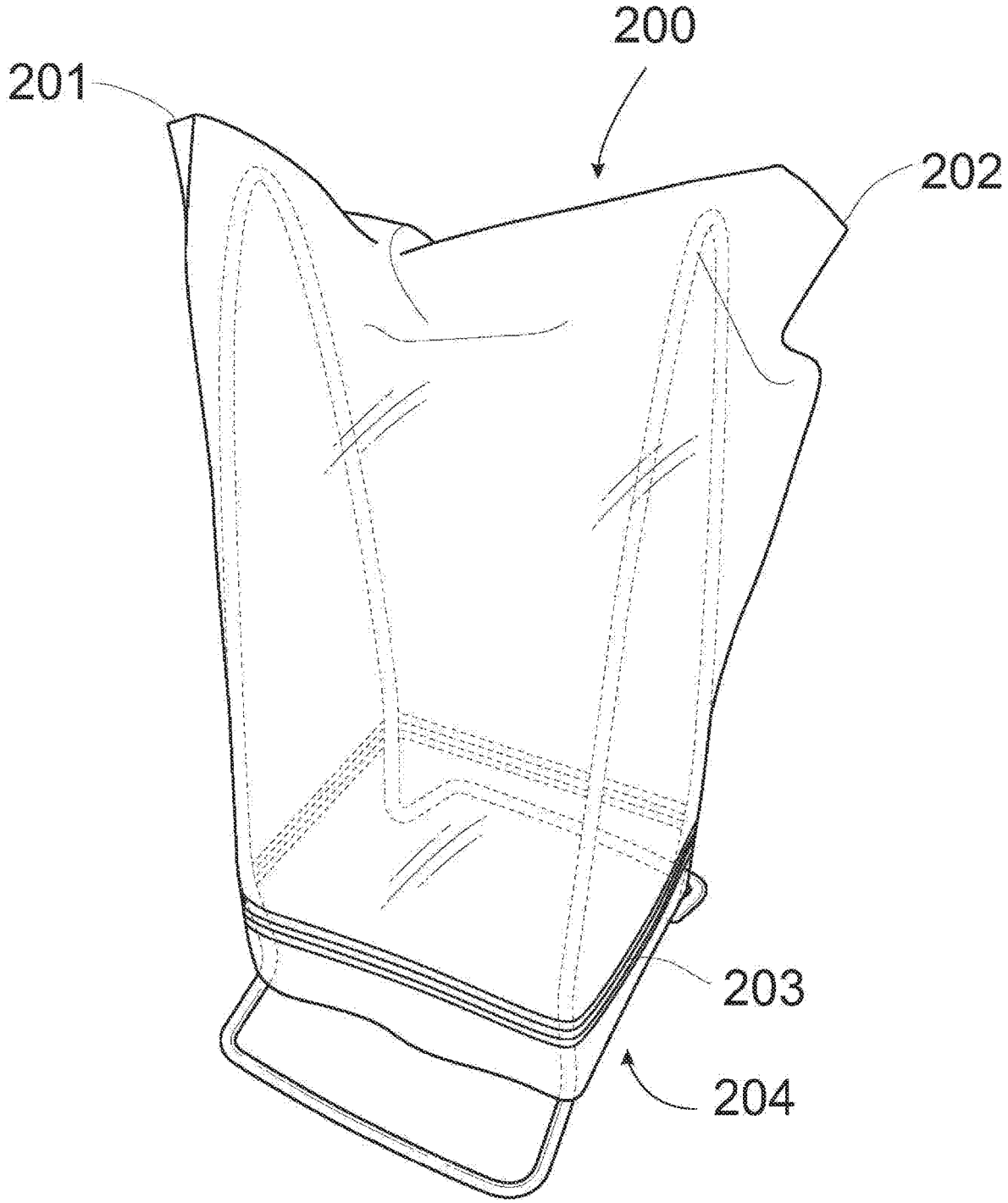
FIG. 2 is a perspective view of the invention with a plastic storage bag installed and ready for use according to an embodiment of the present invention.
Figure 4:
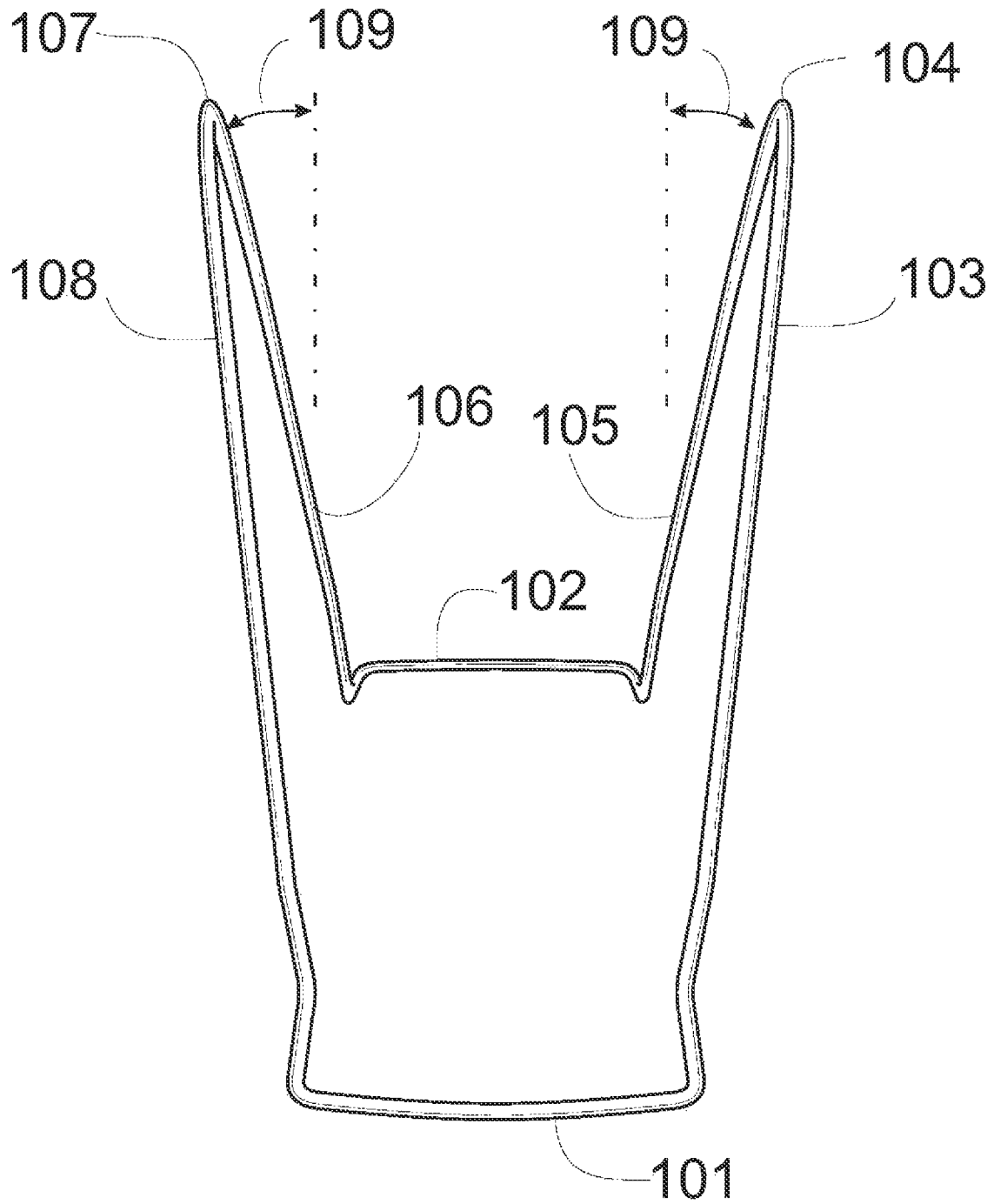
FIG. 4 is a side perspective view of the plastic storage bag saver according to an embodiment of the present invention.

Best seen in FIG. 2, the first and second arch are configured to receive a flexible storage plastic bag 200, such as a Ziploc® bag or similar. In this method, the lower corners 201 and 202 of the plastic bag 200 are spread open by each arch of the plastic storage bag saver 100. In some embodiments, it is beneficial that the first and second arches are angled or bowed outwardly in respect to a vertical axis (see 109; FIG. 4). It should be understood that the size and dimensions of the invention may vary as well as the plastic storage bag, however having the arches bowed outwardly ensures each lower corner 201 and 202 are sufficiently spread. This ensures the bag, and particularly the lower corners of the bag, can be adequately cleaned when placed in the dishwasher.

Figure 3:
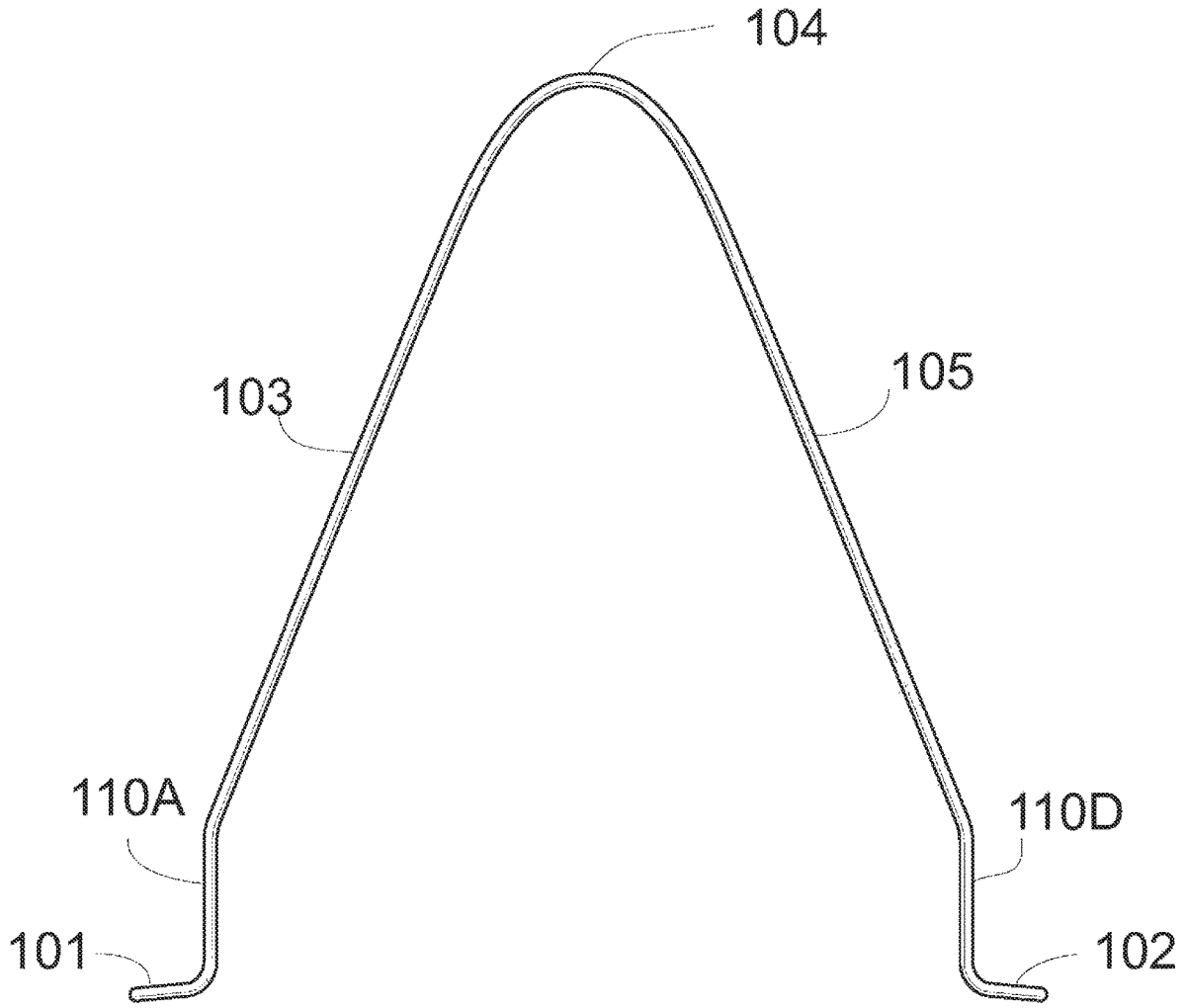
FIG. 3 is a front view of the plastic storage bag saver according to an embodiment of the present invention.
Figure 5:
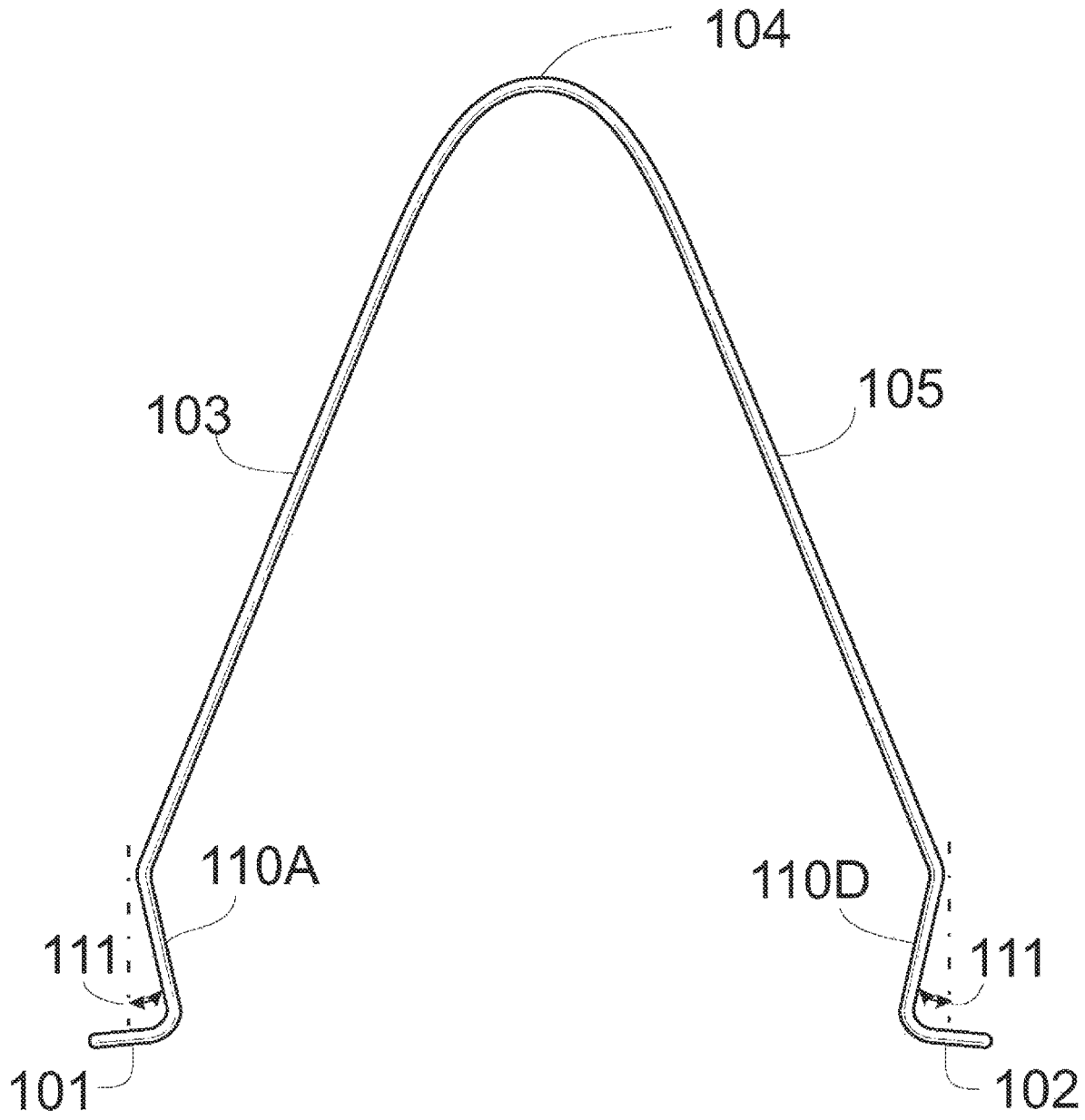
FIG. 5 is a front view of an alternative plastic storage bag saver according to an embodiment of the present invention.

In some embodiments, a bag seam relief portion is provided between each arch member and the respective base portion indicated by element numbers 110A/110B/110C/110D. In one embodiment, the bag seam relief portion is positioned vertically (as seen in FIG. 3). In another embodiment, the bag seam relief portion is angled inwardly (see 111; FIG. 5). Advantageously, the bag seam relief portion is configured to reduce the stress of the bag's seams as the plastic bag is stretched open on the device. More specifically, the tension force provided by plastic storage bag saver 100 along the seams of the bag and particularly the seams near the fastening element (203; FIG. 2) is reduced as the angle increases. This ensures the plastic storage bag has a long life cycle as it is a particular advantage of the present invention to increase the usability and life cycle of a plastic storage bag, reducing waste, and the need to purchase more bags in the future. In one embodiment, the bag seam relief portion is angled inwardly at 45 degrees. In one embodiment, the bend of the inward angle should be approximately ½ inch from the seam of the bag at the fastener location to adequately provide tension relief to the bag's seam.

During use, after a flexible plastic storage bag 200 is used, dirty, or deemed ready to wash, it is opened and fed downward over each crown, wherein the opening 204 of the bag is held open by the shape of the device. In some embodiments, the first and second arch members may be pushed inwardly to allow for each crown of the device to enter the bag's opening. Ideally, the bag 200 should be slid down the device such that the fastening member 203 or opening is approximate to the bag seam relief portion of each arch member. Next, the device with the bag attached is place in the dishwasher with the pair of base members supporting the device on the dishwasher rack. This may be in either rack of the dishwasher depending on the height of the bag and device. Advantageously, since the flexible plastic storage bag is held open by the device, the inside (and outside) of the flexible plastic storage bag 200 is thoroughly cleaned during the dishwasher washing cycle. Finally, the device with the attached flexible plastic bag 200 is removed from the dishwasher. The bag may now be removed in a similarly reverse fashion as installed or left on the device, which can act as a drying rack until the bag is sufficiently dry for reuse.

In one embodiment, the device is constructed from a stainless steel rod. It should be understood that the material may vary, and should have the following characteristics: (a) dishwasher safe; (b) sturdy enough to apply tension force to the flexible plastic bag such that the device spreads the bag open; and (d) it should be flexible enough to be able to compress the arches inward such that the flexible storage plastic bag can be easily removed without damaging the seams of the bag. In some embodiments, the device may include a coating to promote the longevity or ornamental appearance of the device, such as color.

It should be understood that the size of the device and each component may vary depending on the size of the flexible plastic bag it is intended to be used with. In one embodiment, the distance between the first and second arches at the greatest point is approximately 5 inches, wherein the midpoint of the distance to a crown is approximately 6 inches in height. In one embodiment, the bag seam relief portion height is approximately 1 inch. In one embodiment, the width of each base rod is approximately 1.5 inches with a depth of approximately 4 inches. In this embodiment, the device would have an overall footprint of approximately 8"×4.5"×7" for the width, depth, and height respectively as the depth of the device increases since each arch member is bowed outwardly as previously discussed. Likewise, the diameter or gauge of the rod may vary. In one embodiment, the diameter of the rod is ⅛". In one embodiment, the wire gauge is between 8 to 12. The gauge selected should be strong enough to perform the functions described herein, while also enabling the user to change the distance between each arch member or crown such that the flexible plastic bag can be installed and removed from the device. Further, although a rod is shown, the cross-sectional shape of the device may be square, rectangular, diamond, or any other shape.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

For example, in some embodiments, the base portions of the device may include weights to ensure the device stays upright during the dishwashing cycle. In other embodiments, the device may include fastening elements, such as clips to secure the device to the dishwasher rack.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A plastic storage bag system comprising:

a flexible plastic storage bag;

a plastic storage bag saver; wherein the plastic storage bag saver comprises a pair of base rods configured to rest on a dishwasher rack;

a pair of vertical arched support rods extending from the pair of base rods, each of the pair of vertical arched support rods forming a crown at a top portion of the plastic storage bag saver, wherein the pair of vertical arched support rods are bent outwardly and form a bag spreader configured to spread and secure the flexible plastic storage bag in an open position, wherein sides of the flexible plastic storage bag are configured to extend over the pair of vertical arched support rods enabling a pair of lower corners of the flexible plastic storage bag to be spread open in an inverted position by the pair of vertical arched support rods and, wherein the pair of base rods and the pair of vertically arched rods are formed via a single bent rod.

2. The plastic storage bag saver of claim 1, wherein the single bent rod is comprised of stainless steel.

3. The plastic storage bag saver of claim 1, wherein the single bent rod is ⅛" diameter.

4. The plastic storage bag saver of claim 1, wherein the pair of base rods horizontally extend from the pair of vertical arched support rods.

5. The plastic storage bag saver of claim 1, wherein the pair of vertical arched support rods includes at least one angled portion approximate to a proximal portion of the pair of vertical arched support rods, wherein the at least one angled portion is perpendicular to the pair of base rods, and wherein the at least one angled portion reduces tension stress forces of the flexible plastic storage bag's seam.

6. The plastic storage bag saver of claim 5, wherein the at least one angled portion is at an acute angle relative to a vertical axis.

7. The plastic storage bag saver of claim 1, wherein the pair of vertical arched support rods are bowed outwardly such that the bag spreader is configured to spread the flexible plastic storage bag's lower corners.

8. A plastic storage bag system comprising:

a flexible plastic storage bag;

a plastic storage bag saver; wherein the plastic storage bag saver comprises a first horizontal base rod having a first end and a second end; a second horizontal base rod having a third end and a fourth end; a first vertical crown having a first apex and a first lower end and a second lower end; a second vertical crown having a second apex and a third lower end and a fourth lower end; wherein the first end of the first horizontal base is connected to the first lower end of the first vertical crown, the second end of the first horizontal base is connected to the third lower end of the second vertical crown, and the third end of the second horizontal base is connected to the second lower end of the first vertical crown, the fourth end of the second horizontal base is connected to the fourth lower end of the second vertical crown; and, wherein the first vertical crown and the second vertical crown are bent outwardly and together form a bag spreader configured to spread and secure a flexible plastic storage bag in an open position, wherein sides of the flexible plastic storage bag are configured to extend over the first vertical crown and the second vertical crown enabling a pair of lower corners of the flexible plastic storage bag to be spread open in an inverted position by the first vertical crown and the second vertical crown, and the first horizontal base rod and the second horizontal base rod are configured to rest on a rack of a dishwasher such that the flexible plastic storage bag may be washed in a dishwasher cycle via the dishwasher.

* * * * *